US007413057B2

(12) United States Patent
Ellison, Jr. et al.

(10) Patent No.: US 7,413,057 B2
(45) Date of Patent: Aug. 19, 2008

(54) VERTICAL TRANSPORT SYSTEMS AND METHODS

(75) Inventors: Lloyd L. Ellison, Jr., Fletcher, VT (US); Robert C. Hinkley, Milton, VT (US); Kenneth A. Comeau, Williston, VT (US)

(73) Assignee: General Dynamics Armament and Technical Products, Burlington, VT (US)

( * ) Notice: Subject to any disclaimer, the term of this patent is extended or adjusted under 35 U.S.C. 154(b) by 0 days.

(21) Appl. No.: 11/555,035

(22) Filed: Oct. 31, 2006

(65) Prior Publication Data

US 2008/0173501 A1 Jul. 24, 2008

Related U.S. Application Data

(60) Provisional application No. 60/731,236, filed on Oct. 31, 2005.

(51) Int. Cl.
*B66B 9/02* (2006.01)
*B66B 9/06* (2006.01)
*B66B 7/04* (2006.01)

(52) U.S. Cl. ..... 187/270; 187/245; 187/409

(58) Field of Classification Search ..... 187/201, 187/245, 270, 409; 104/54, 127
See application file for complete search history.

(56) References Cited

U.S. PATENT DOCUMENTS 561,223 A * 6/1896 Hamilton ..... 198/800
651,236 A * 6/1900 Corcoran ..... 187/250
826,812 A * 7/1906 Wingren ..... 238/169
1,930,239 A * 10/1933 Hunt ..... 187/249
2,514,498 A * 7/1950 Kesler ..... 187/270
3,924,710 A * 12/1975 Shohet ..... 187/270
4,516,663 A * 5/1985 D'Alessio et al. ..... 187/270
5,921,351 A * 7/1999 Schroder-Brumloop ..... 187/255
6,053,286 A * 4/2000 Balmer ..... 187/201
6,666,147 B1 * 12/2003 Minges ..... 104/128
7,185,741 B1 * 3/2007 Rozenfeld ..... 187/200
2005/0279580 A1 * 12/2005 Szentistvany ..... 187/201

FOREIGN PATENT DOCUMENTS

GB 2358389 A * 7/2001
WO WO 2004014773 A1 * 2/2004

* cited by examiner

*Primary Examiner*—Peter M. Cuomo
*Assistant Examiner*—Eric Pico
(74) *Attorney, Agent, or Firm*—Hunton & Williams

(57) ABSTRACT

The invention provides for a transport system and method of using the transport system. The transport system may include a transport track; and a platform assembly that transports along the transport track, the platform assembly including (1) a cargo platform; and (2) a pair of drive pinion trucks mounted on opposing sides of the cargo platform, each drive pinion truck engaged with the transport track for movement along the transport track. The drive pinion trucks may be provided with a leveling system to provide leveling of the cargo platform during operation.

21 Claims, 16 Drawing Sheets

VERTICAL TRANSPORT SYSTEMS AND METHODS

This application claims priority to U.S. Provisional Application Ser. No. 60/731,236 filed Oct. 31, 2005, such provisional application being incorporated herein by reference in its entirety.

BACKGROUND OF THE INVENTION

The invention is directed to systems and methods for providing transport.

As the United States Navy moves its sea basing visions forward, underway replenishment (UNREP) operations will be required to be completed at increased rates and during higher sea states than current facilities and procedures allow. The Navy standard elevator has been identified as a key technology gap that will need to be addressed in order to achieve the goals of Future Naval Capability (FNC).

Currently, elevator operations and, more specifically, the time required to load/unload elevators and transport between elevators are the biggest bottleneck in shipboard cargo and weapons strike-up and strike-down operations. Additionally, in an effort to increase ship survivability, many future combatants will require a ropeless elevator capable of crossing gaps to allow for ballistic hatches to remain normally closed during ship operations.

The systems and methods of embodiments of the invention address the above needs and others.

BRIEF SUMMARY OF THE INVENTION

The invention provides for a transport system and method of using the transport system. The transport system may include a transport track; and a platform assembly that transports along the transport track, the platform assembly including (1) a cargo platform; and (2) a pair of drive pinion trucks mounted on opposing sides of the cargo platform, each drive pinion truck engaged with the transport track for movement along the transport track. The drive pinion trucks may be provided with a leveling system to provide leveling of the cargo platform during operation.

BRIEF DESCRIPTION OF THE DRAWINGS

The present invention can be more fully understood by reading the following detailed description together with the accompanying drawings, in which like reference indicators are used to designate like elements, and in which.

DETAILED DESCRIPTION OF THE INVENTION

Hereinafter, aspects of a transport system in accordance with various embodiments of the invention will be described. As used herein, any term in the singular may be interpreted to be in the plural, and alternatively, any term in the plural may be interpreted to be in the singular.

Figure 1:
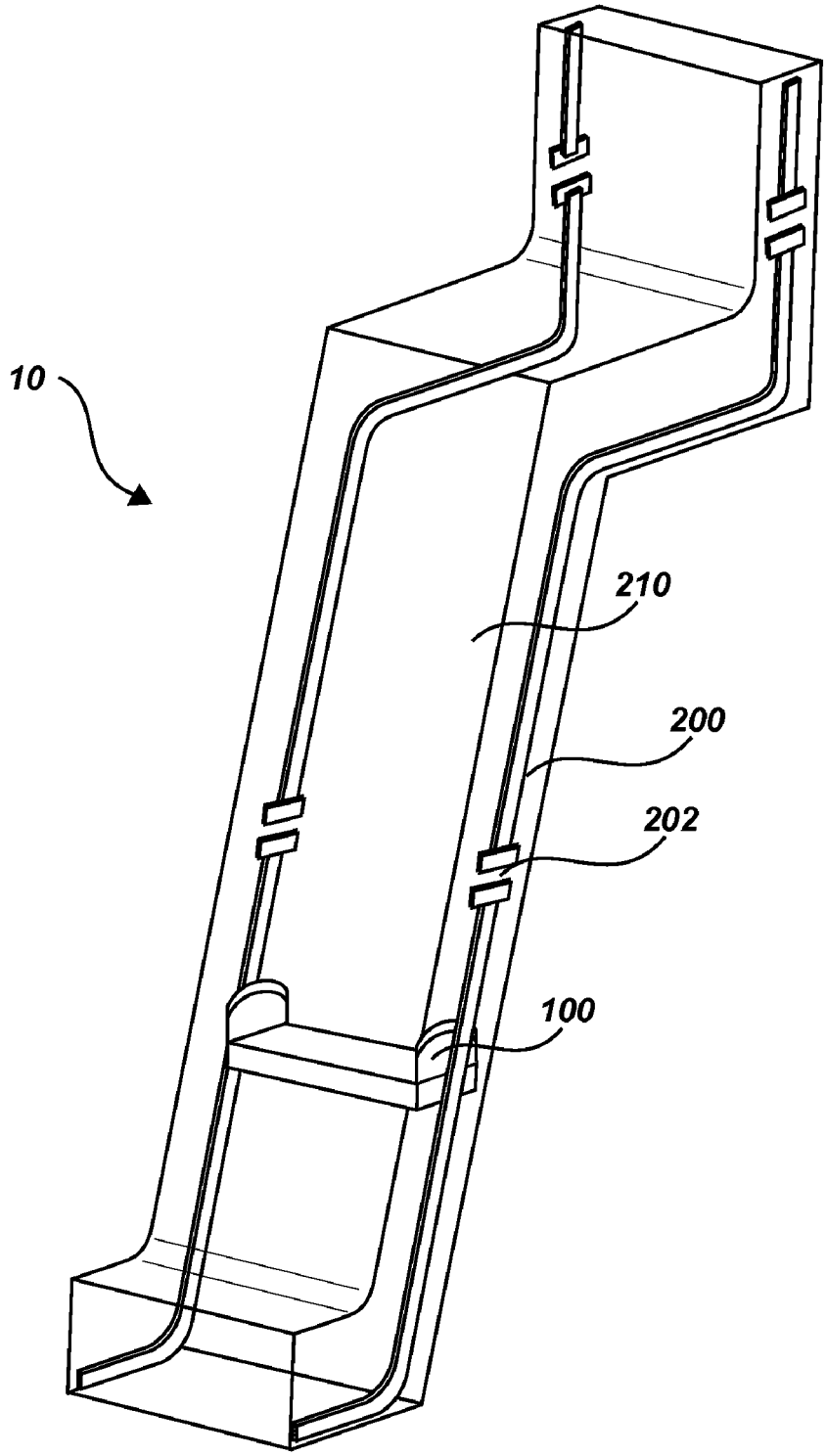
FIG. 1 is a perspective view of a transport system in accordance with one embodiment of the invention.

Embodiments of the invention provide a high capability elevator designed to carry materiel cargo from a point to any other point in the XZ or YZ planes. The elevator is capable of operating in the horizontal direction, vertical direction, or any angle between these directions. The drive system of the elevator is capable of continuous operation as the platform transitions between the horizontal, vertical, or angled directions providing continuous, seamless movement of the elevator cargo within an elevator trunk. FIG. 1 provides a basic elevator configuration that shows the systems ability to transition directions at various angles.

Hereinafter, further details of embodiments will be described. A transport system 10 in accordance with one embodiment of the invention is shown in FIG. 1. The transport system 10 includes a platform assembly 100 and a transport track 200. As described in detail below, the platform assembly 100 is equipped with an automated platform leveling device to ensure that the platform assembly 100 remains level throughout operation, i.e., through transport via the transport track 200. An elevator control system tracks the location of the platform on the transport track 200, thus calculating the angle of the platform assembly 100 relative to a ship, or other structure. This calculation is then utilized to rotate large bull gears located at either end of the platform to maintain level in relation to the ship.

The platform assembly 100 provides for crossing of gaps in the transport track 200. That is, the platform assembly 100 operates within a trunk 210 in which the transport track 200 is disposed. In the trunk 210, gaps exist in the rails (of the transport track 200) along which the platform assembly 100 travels. The gaps in the transport track allow sections of the trunk 210 to be sealed off from each other, thus increasing survivability in the event of damage.

Hereinafter, further details of embodiments of the invention will be described. In an effort to address the technology gap that exists between the Navy standard elevator and the requirements for an elevator system capable of meeting current goals, the invention provides an elevator drive system capable of achieving current performance and ship survivability goals. The invention provides a drive system that allows for seamless transition between vertical, horizontal, and diagonal sections of an elevator trunk as well as the ability to cross gaps within the trunk that allow for the operation of ballistic hatches.

Embodiments of the invention provide a variety of advantages. The specifications provided below are merely illustrative as to some embodiments and are not limiting.

The transport system 10, as shown in FIG. 1, is capable of automatically transferring from movement in vertical to horizontal direction and vise versa without the need for loading/unloading the platform. Further, the system maximizes system throughput through automated entry and exit of the platforms from the elevator trunk at multiple levels and/or the operation of multiple platforms within the same elevator trunk, and/or automated loading/unloading of the platforms. The system is capable of operation while allowing for bulkhead doors and ballistic hatches. In particular, the system is capable of transitioning gaps, e.g., 12 inch gaps, caused by bulkhead doors and ballistic hatches when they are in the open position. Further, in some embodiments, the system supports diagonal elevator paths at any angle from vertical to enable operation parallel to the ships hull. The system performs normal operations while the vessel experiences substantial heave, pitch and roll motions. The transport system 10 provides for needed ship flexure. For example, the transport system 10 may allow for ship flexure of 0.43 in of deflection in the horizontal or vertical plane over a 100 ft span and shall not exert a force back onto the ships structure opposing the movement while the ship structure experiences flexure through Sea State 9. In embodiments, the system weight may not exceed the weight of the existing Navy standard elevator system which it would replace. The foundations of the transport system 10 shall ensure that the fundamental frequencies exceed 12.5 Hz. The system may be provided so as to not exceed 225 kW while operating at rated load and throughput in Sea State 5 during strike-up and strike-down operations (SUSD). Various other capabilities may be provided for in embodiments of the invention.

Embodiments of the invention may provide a capacity of 24,000 lb and an average throughput of 756 tons per hour. The system may have a minimum usable platform size of 18 ft long by 8 ft wide. However, the particular dimensions may of course be varied as desired. In some embodiments, the platform assembly 100 speed shall not exceed 120 ft/min at rated load, and may maintain a positional accuracy of ±¼ in with the surface of the deck. Further, the platform assembly 100 may sustain eccentric loading. For example, the platform assembly 100 may maintain the alignment of the deck under an eccentric loading of up to 48,000 ft-lb.

As described below, the platform assembly 100 may be provided with suitable brake assemblies. The system brakes may be capable of stopping the platform with rated load and rated speed within 3 feet of brake initiation. Further, the system may include a dedicated emergency brake system that is capable of stopping the platform with 150% rated load at 115% of rated speed within 3 ft of initiation, for example. Further, the system may include a parking brake capable of holding the platform with 400% rated load (96,000 pounds), in a static, unbalanced configuration, for a minimum duration of 10 minutes. For this situation 300% of the rated load (72,000 pounds) may be centered at ¼ length from an end, and 100% of the rated load centered at ¼ length from the other end.

The systems and methods of the invention have been described above in summary. Hereinafter, further details of embodiments will be described with reference to the drawings.

The platform assembly 100 shown in FIG. 1, is an elevator platform designed for shipboard use, for example, that can translate in both the vertical and horizontal directions in a vertical plane. However, the transport system 10 might be used in other structures, i.e., other than a ship. The platform assembly 100 can move vertically as an ordinary elevator does, but can also transition to any angle (in the vertical plane) as dictated by a ship's hull shape or design layout. In addition, the system is capable of crossing gaps of 12 inches for example, within the elevator trunk and guide rails. This feature accommodates the installation of watertight doors/hatches in the elevator trunk, such as between decks.

Figure 2:
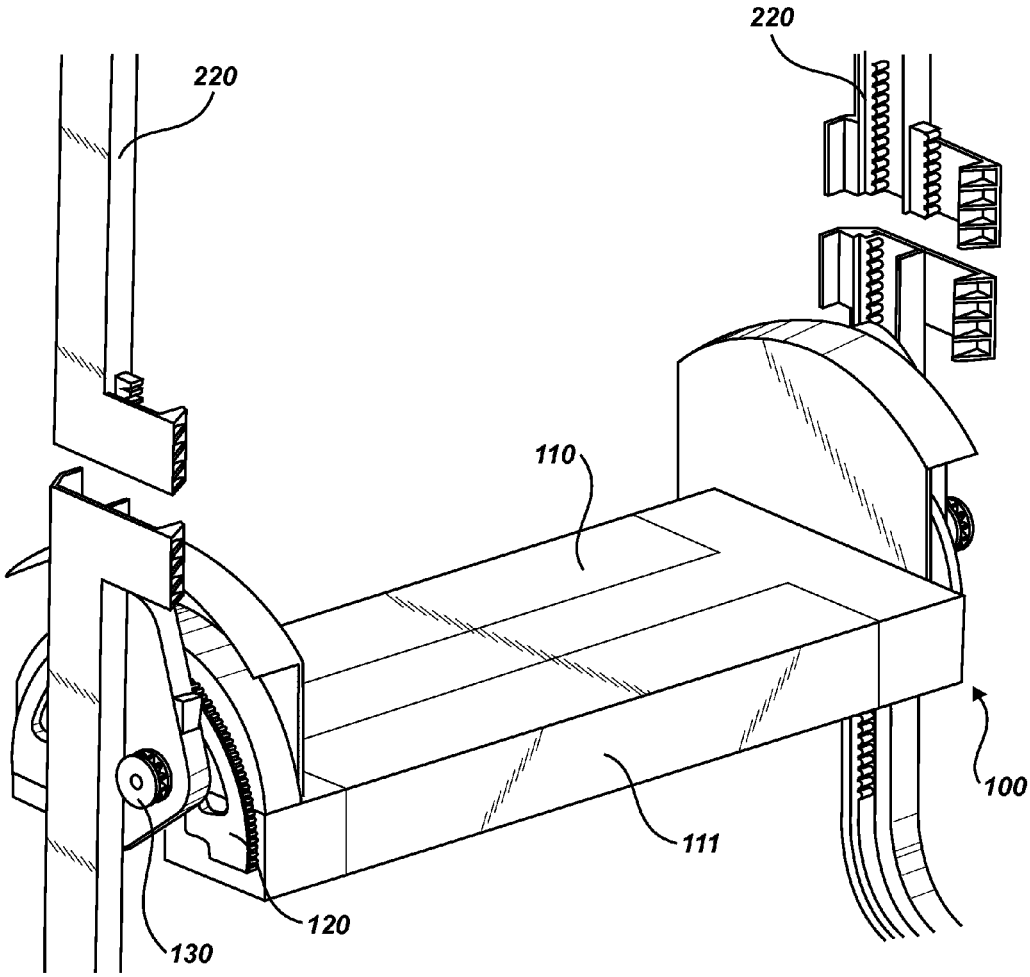
FIG. 2 is a perspective view of a platform leveling subsystem in accordance with one embodiment of the invention.

The transport system 10 is powered by a rack and pinion drive system that employs two guide/gear racks 220 and two drive pinion trucks 130. The gear racks, guide rails, and pinion trucks are located at the ends of the cargo platform on its long centerline as depicted in FIG. 2. The cargo platform 110 is allowed to pivot on its long centerline in order to maintain a level deck as platform assembly 100 transitions from vertical travel to horizontal travel or any angle in between. The cargo platform level is directly and positively controlled by the platform leveling system which is partially housed in the pinion trucks at each end of the cargo platform, as shown in FIG. 2.

The system is designed to provide safe and reliable operation. Safety features include redundancy in both drive and braking systems, strong yet lightweight structural design, protective shields, and emergency subsystems.

The various transport system 10 functions may be controlled by a microprocessor based control system, or any other suitable computer system. For example, the control system may be patterned after current commercial elevator control systems in some respects, e.g., in controlling cargo platform 110 movement between deck to deck. These systems allow great control flexibility and versatility and are in wide use. These systems also allow for easy programming of operational parameters that may be modified to optimize throughput.

Figure 3:
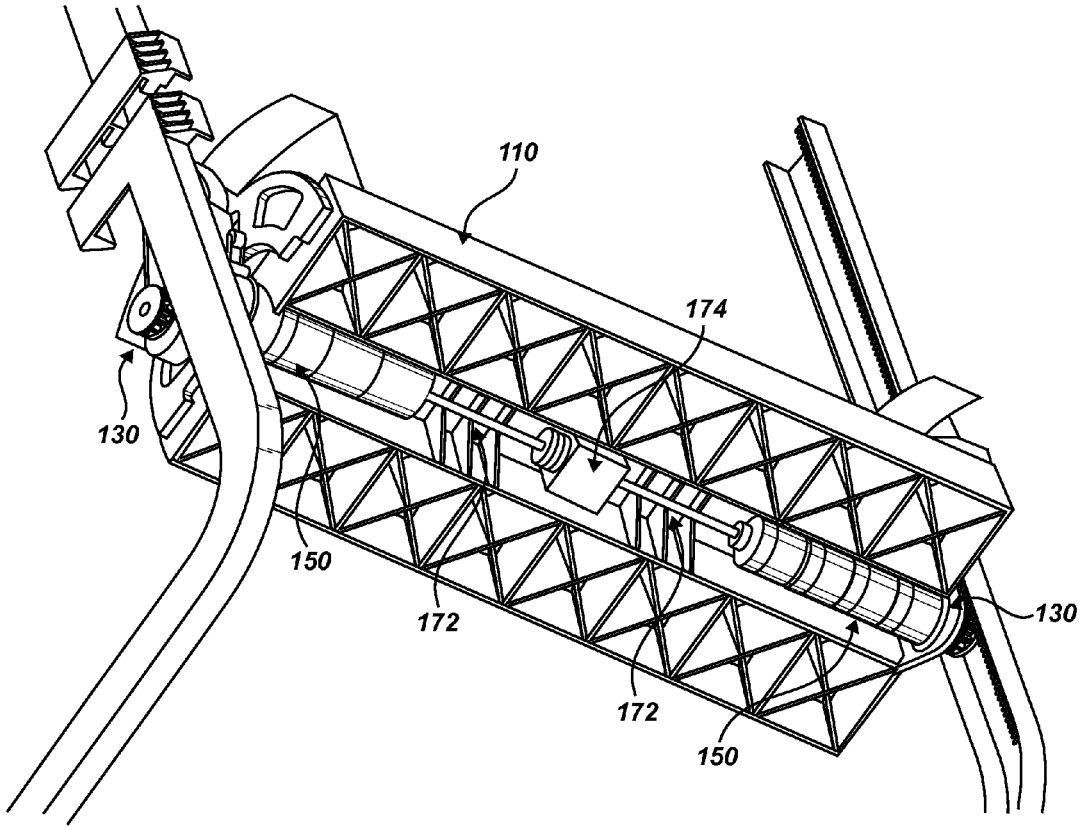
FIG. 3 is a perspective view of a platform drive system in accordance with one embodiment of the invention.
Figure 4:
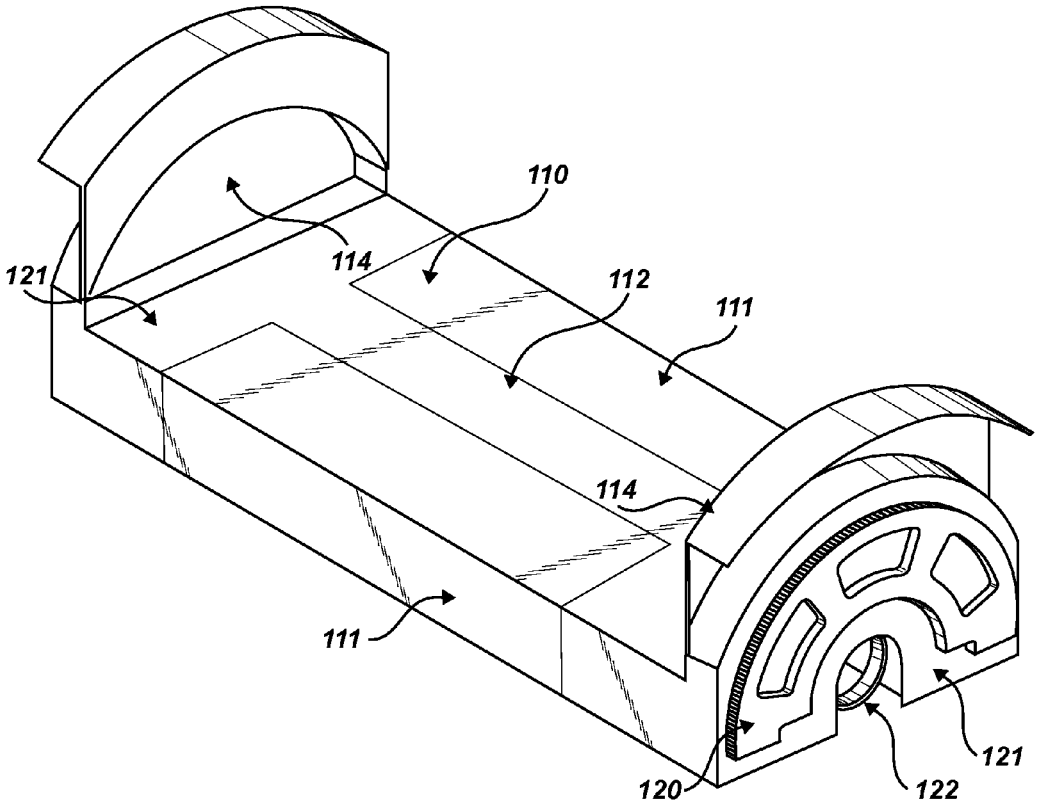
FIG. 4 is a perspective view of a platform structure in accordance with one embodiment of the invention.
Figure 5:
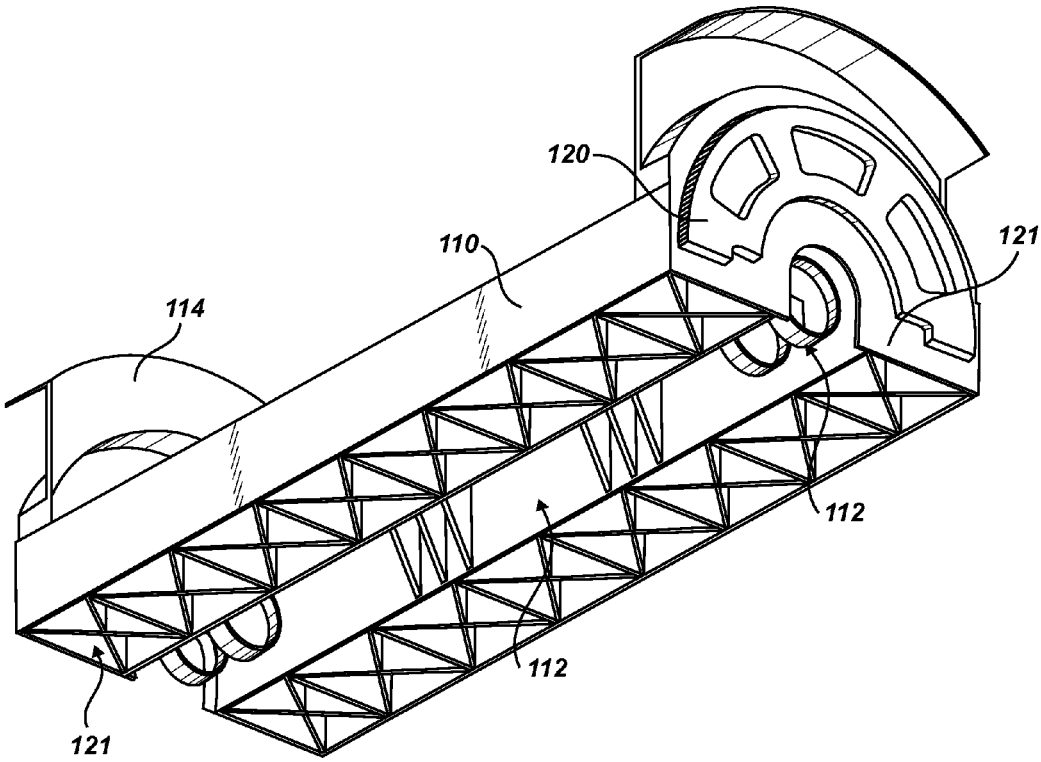
FIG. 5 is a further perspective view of a platform structure in accordance with one embodiment of the invention.

As shown in FIG. 2, the platform assembly 100 includes the cargo platform 110. Further details of the cargo platform 110 are shown in FIGS. 3-5. The cargo platform can be designed for any application. For example, the design may utilize a platform with a length of 19 ft, a width of 8 ft and a depth of 2 ft. Approximately 6 inches of deck space at each end may be used by transport system mechanical equipment leaving 18 ft of platform deck length for cargo.

As shown in FIG. 4, the platform structure employs a ridged structural spine 112 along its long centerline. This structural spine 112 carries cargo loads outward to the pinion trucks 130 and primary drive systems at both ends of the platform. Further, the structural spine 112 provides a rigid mounting surface for the pivot bearings 122 on which the cargo platform 110 pivots. These pivot bearings 122 are shown in both FIG. 4 and FIG. 5.

Figure 9:
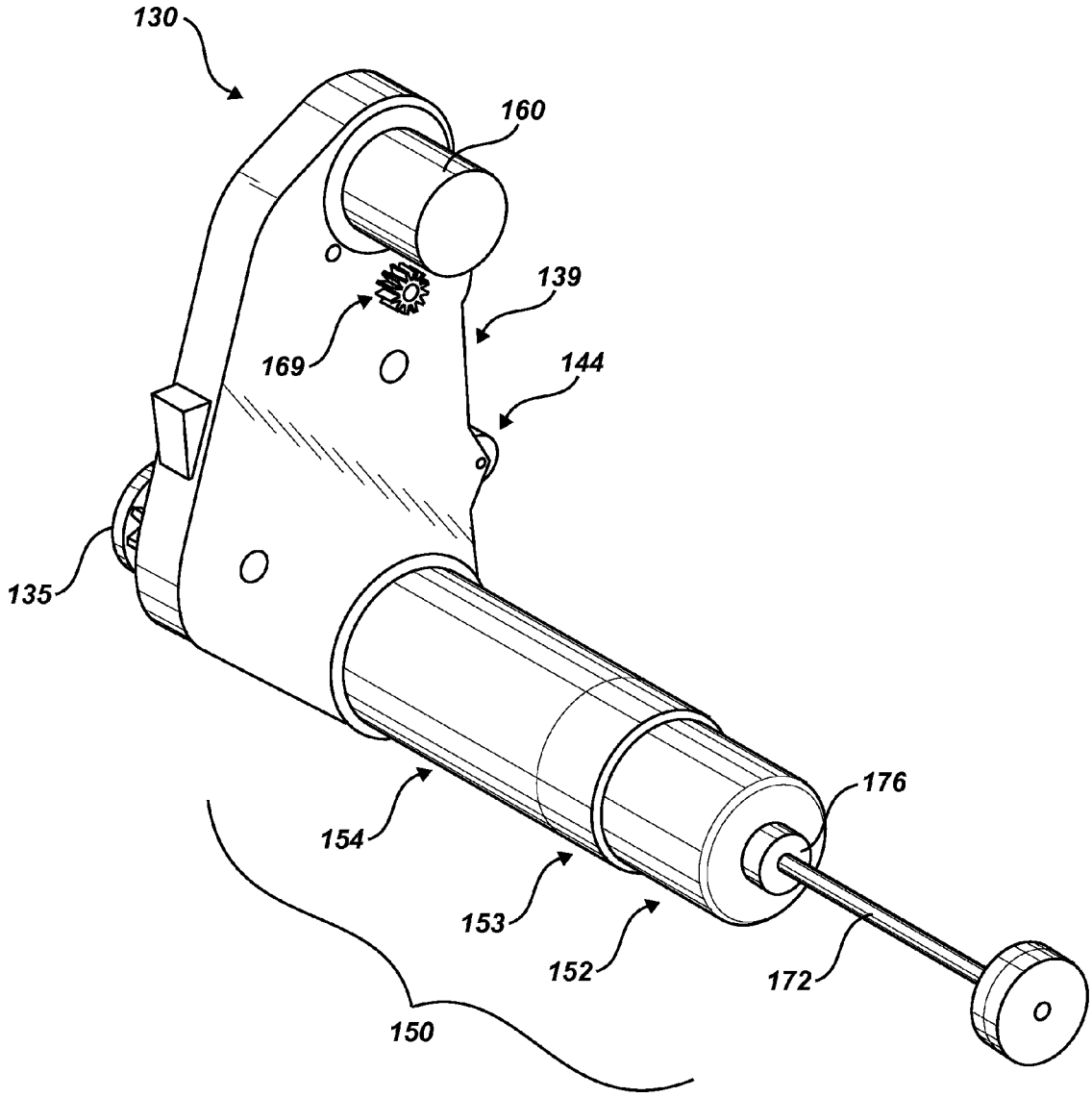
FIG. 9 is a perspective view of a pinion truck and primary drive system in accordance with one embodiment of the invention.
Figure 11:
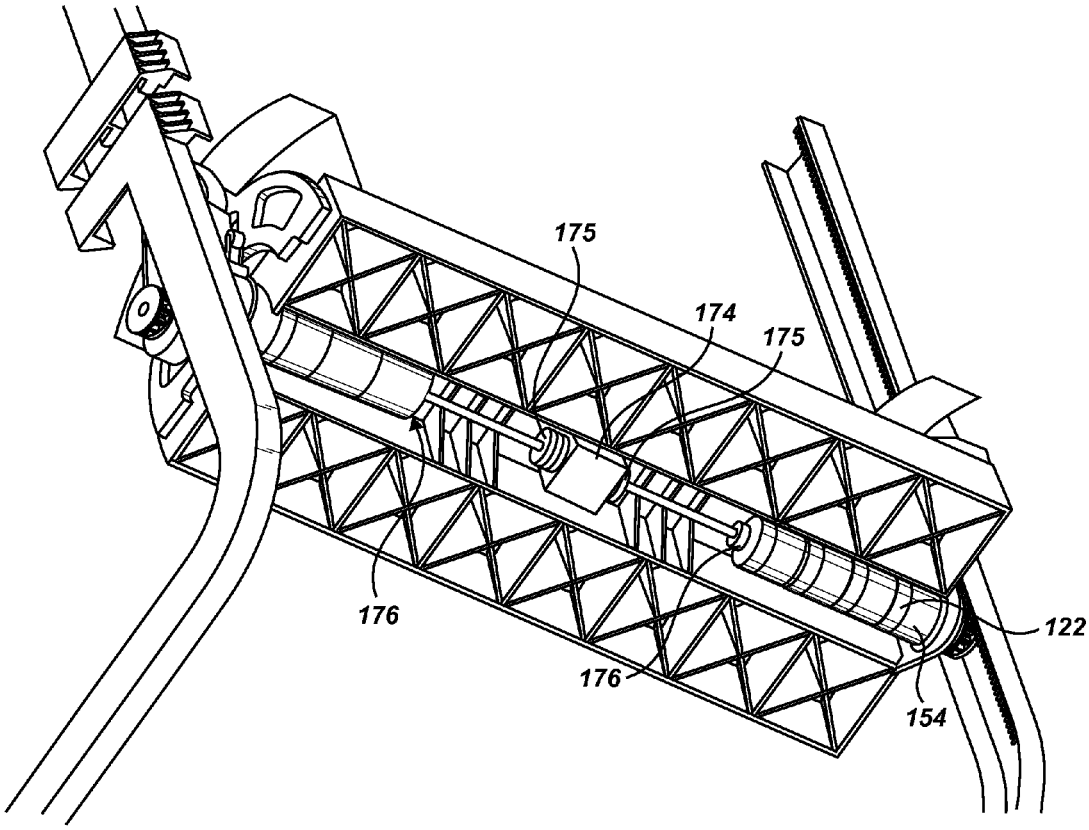
FIG. 11 is a perspective view of a cargo platform showing brakes and an emergency gearbox in accordance with one embodiment of the invention.

Deck loads are carried through the pivot bearings to the outside diameters of the gear reducer housings 154 in the primary drive system 150, as shown in FIG. 9. Loads are ultimately transferred to the walls of the transport system 10, i.e., to the trunk and ship structure, through the gearbox housings, pinion bearings, pinion shafts, pinion teeth and the gear rack. This arrangement is shown in FIGS. 2 and 3. The central spine 112 encloses the primary drive system 150, which is attached to the pinion trucks 130. The primary drives 150 may be mechanically linked by jackshafts, which run through and are protected by the central spine structure 112. As shown in FIGS. 3 and 11, an emergency gearbox 174 is also mounted in the center of the central spine structure 112. The primary drive jackshaft 172 passes through this gearbox and is supported by the emergency gearbox 174. Accordingly, the emergency gearbox 174 is used as a center bearing.

Hereinafter, further details of the cargo platform 110 and structure thereof will be described. As shown in FIG. 4, the cargo platform 110 includes the structural spine 112, as described above. Platform sections 111 are disposed on both sides of the central spine, as shown in FIGS. 4 and 5. The platform sections 111 are lightweight structures designed to support cargo and augment the torsional rigidity of the central spine 112. These sections of the platform may employ structural composite materials to maintain a lightweight assembly, thus helping to reduce power consumption. The platform sections 111 may be attached to the structural spine 112 in any suitable manner, i.e., such as welding or bolts. As shown in FIG. 4, protective shields 114 may be provided on each end of the cargo platform. The protective shield 114 provides protection (for an operator or cargo, for example) against inadvertent contact with the leveling bull gear 120, transport track 200 and/or other components of the transport system.

In accordance with one embodiment of the invention, the leveling system of the transport system 10 uses electric motors with reduction gearing and large bull gears to maintain a platform level condition. As shown in FIGS. 4 and 5, leveling system bull gears 120 are attached to both ends of the platform assembly 100. Leveling moments are transferred from the bull gears back into the central spine by structural spurs 121 extending from the spine outward to the perimeter of the cargo platform 110.

Figure 6:
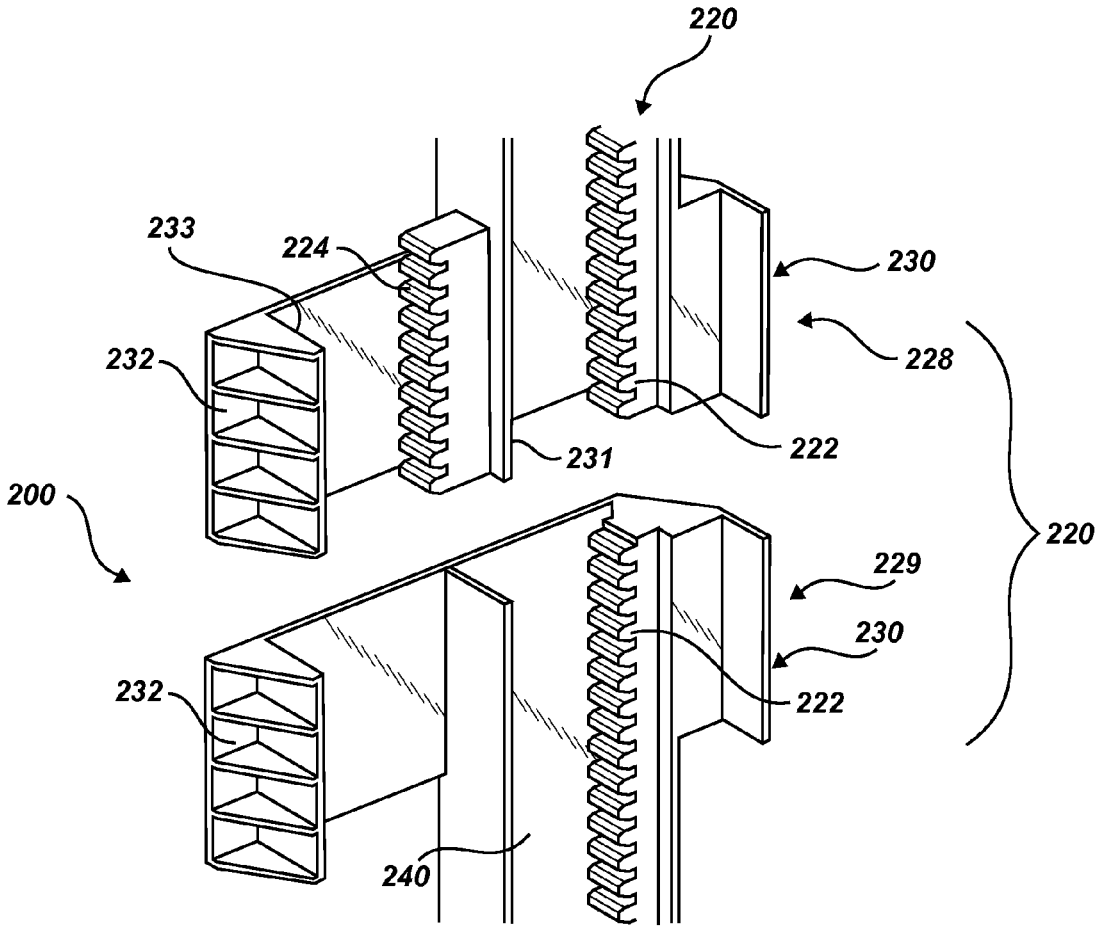
FIG. 6 is a perspective view of gear track and rack assembly in accordance with one embodiment of the invention.

FIGS. 2 and 3, as well as FIG. 6, show features of the transport track 200 and platform assembly 100 mounted thereon. In particular, FIG. 6 shows the guide rail-guide rack assembly 220. In the transport system 10, guiding and drive loads are ultimately transferred into the ship's structure/trunk walls through the guide track and rack assembly 220. System drive pinions at both ends of the cargo platform climb or descend the gear racks, which are housed inside the guide rails. The direction of platform assembly 100 travel is directly controlled by the walls of the transport track 200 and guide rail-guide rack assembly 220. Platform tipping moments created by off center deck loads, leveling system drive inputs and reaction moments created by the driving forces of the pinion are reacted by the walls of the guide rail-guide rack assembly 220.

As shown in FIG. 2, for example, the guide rail-guide rack assembly 220 provides what might be characterized as a two track system, in accordance with one embodiment of the invention. The two track system provides various beneficial attributes, as compared to a four-track system, for example. For example, the two-track system provides a decreased risk of driveline wind-up and the ability to turn in both directions from the vertical direction of travel. Driving the platform from all four corners with a direct drive system incurs the risk of torque build-up between the four drives. This is the result of dimensional differences between the drives, which are unavoidable. Driving the platform around corners only intensifies the problem. Further, a four-track system would require offset, or biased, truck drive pivot positions to maintain a level deck. This offset would allow the system to turn one direction from vertical, and to return to vertical, but it would preclude travel in the opposite direction. A four-track systems using guide rail switches might be used, but they risk the loss of control of one or more pinion trucks at switch points. However, it is appreciated that a four track system might utilize the features of the invention, given that the appropriate design considerations and limitations were taken into account.

In the two-track system dimensional differences between the two gear racks and drive systems are inevitable, but they result only in slight differences in platform level, side to side, as the transport system 10 travels from one end of its trunk to the other. These differences in platform level will be generally imperceptible. Torque buildup between the two drive systems/trucks 130 is completely avoided. The two-track system turns in either direction without difficulty, thereby greatly enhancing system installation flexibility and design adaptability. Because the gear racks are located on the same side of each guide rail relative to the platform, differences in turning radius and therefore pinion travel from platform end to end are avoided.

In the example described above, the transport system 10 travels from one end of its trunk to the other. However, it is appreciated that the transport track may be in the form of a circle, i.e., a never ending track. Such a track might be disposed and operated such that the cargo platforms 110 go up on one side of the ship and down on the other side of the ship, in a continuous progression. The particular number of platform assemblies utilized in a particular transport system may be varied as desired.

In accordance with one embodiment of the invention, the two-track system does, however, require that the cargo platform pivot relative to the propulsion trucks at each end of the system. That is, the cargo platform must pivot to maintain level, relative to the ship, as the system transitions from vertical to horizontal or angled travel. Space constraints coupled with the need to control the forces and displacements caused by off-center loads effectively eliminate the use of a passive platform leveling system. The transport system 10 is therefore equipped with an active leveling system, further described below.

Hereinafter, features of the drive pinions will be described in accordance with one embodiment of the invention. As described above, the transport track 200 is provided with gaps 202, as shown in FIG. 1. The gaps allow watertight doors to close between decks, i.e., when the platform assembly 100 is not passing the gap 202. The arrangement of the platform assembly 100 (and in particular the drive pinion truck 130 of the platform assembly 100) allows the platform assembly 100 to traverse the gaps 202 in the transport track 200.

Figure 10:
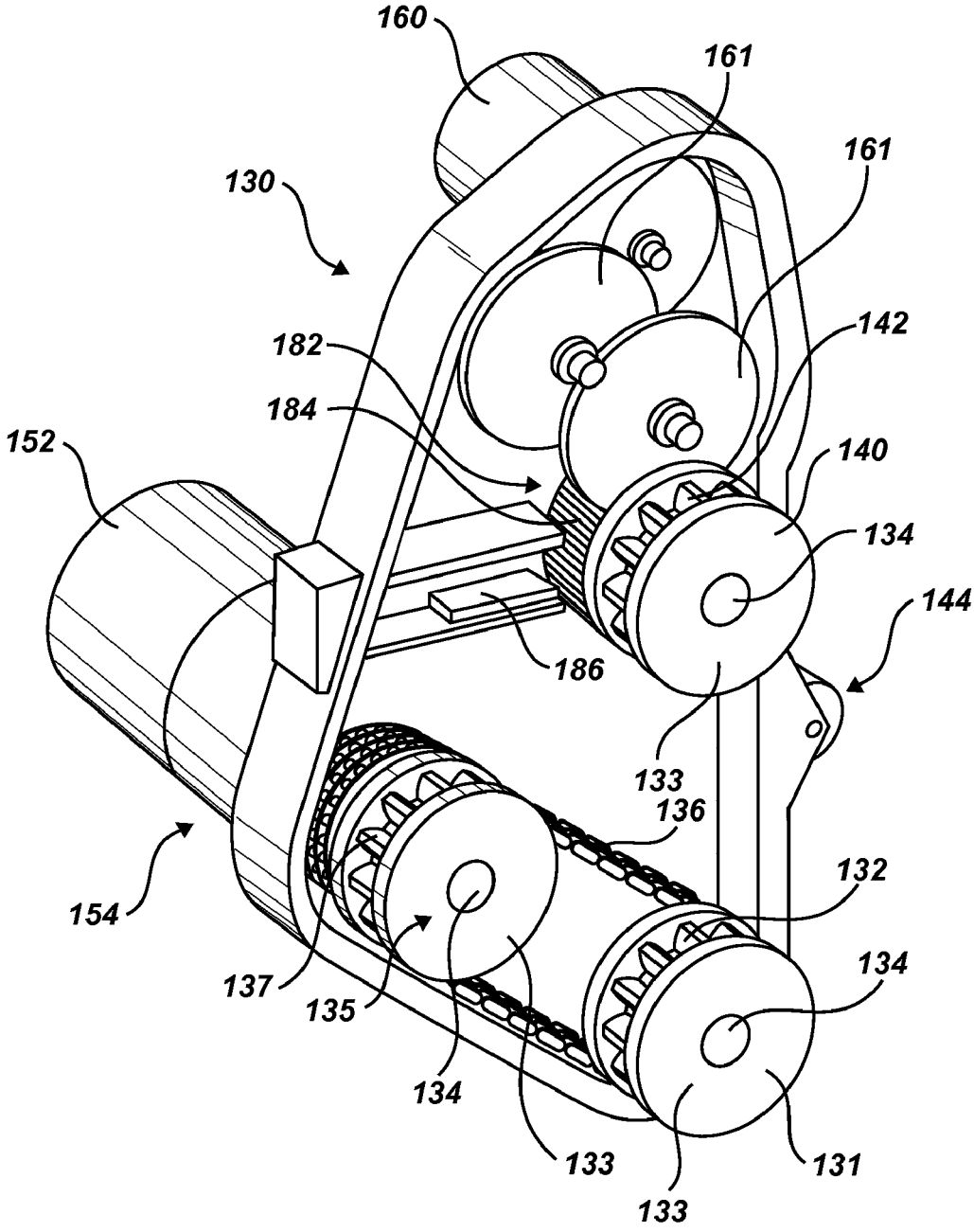
FIG. 10 is a perspective view of a pinion truck in accordance with one embodiment of the invention.

The drive pinion truck 130 is shown in FIGS. 9 and 10. The drive pinion truck 130 includes a primary drive pinion assembly 131. The primary drive pinion assembly 131 is driven by the primary drive system 150. The drive pinion truck 130 further includes a secondary drive pinion assembly 135. The secondary drive pinion assembly 135 is driven by the primary drive pinion assembly 131 via a suitable chain or belt 136. For example, a HY-VO chain might be utilized. The drive pinion truck 130 further includes an idler pinion assembly 140.

FIG. 6 shows details of the transport track 200, and in particular, structure of the transport track 200 adjacent gap 202. The guide rail-guide rack assembly 220 of the transport track 200 includes a primary gear rack 222, as well as a secondary gear rack 224. The pinions of the drive pinion truck 130 travel on the racks (222, 224). Further, the guide rail-guide rack assembly 220 includes a back wing guide 230 and a forward wing guide 232 at gaps.

As shown in FIG. 6, the guide rail-guide rack assembly 220 might be characterized as including an upper rail portion 228 and a lower rail portion 229. However, it is of course appreciated that the upper rail portion 228 of FIG. 6 would then constitute the lower rail portion at some level above the portion of the transport track shown in FIG. 6. As shown, only the upper rail portion 228 includes the secondary gear rack 224. FIG. 6 shows what might be characterized as a left hand track. The transport track 200 would also include a right hand track, which would be a mirror image of the shown left hand track.

Figure 7:
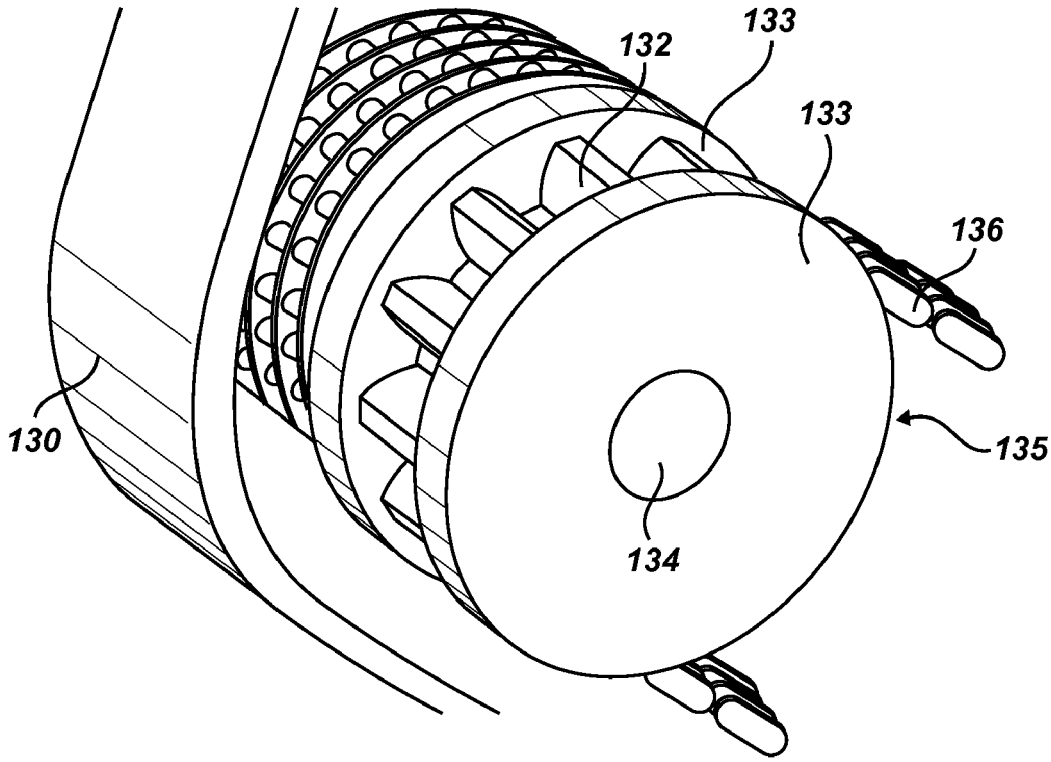
FIG. 7 is a perspective view of a drive pinion assembly in accordance with one embodiment of the invention.

FIG. 10 shows pinion assemblies (131, 135 and 140). Each pinion assembly (131, 135 and 140) includes a pinion shaft 134. Further, each pinion assembly (131, 135 and 140) includes two concentric idler wheels 133, as shown in FIG. 7. The pinion assemblies (131, 135 and 140) also include respective pinions. The primary drive pinion assembly 131 includes a primary drive pinion 132. The secondary drive pinion assembly 135 includes a secondary drive pinion 137. Further, the idler pinion assembly 140 includes an idler pinion 142.

As the drive pinion truck 130 traverses the guide rail-rack assembly 220, contact between the drive pinion truck 130 and gear racks is maintained by the addition of the two concentric idler wheels 133 to each pinion shaft 134. The idler wheels 133, as shown in FIG. 10, are mounted on their own bearings and are free to rotate independent of the associated pinion gear. The idler wheels 133 are positioned on either side of the associated pinion gear (132, 137, 142). The wheels 133 are slightly larger in diameter than the drive pinions (132, 137, 142) and contact the guide rail wall (231 or 233) opposite the associated gear rack (222 or 224).

Each drive (131, 135) pinion assembly or idler (140) pinion assembly is therefore captured in the guide rail 200 between the gear rack on one side and the guide rail wall on the other. As the drive pinion (132, 137, 142) rotates and travels along the gear rack the idler wheels rotate in the opposite direction, but hold the pinion against the rack. The free side of each idler wheel passes along a side of the gear rack, and in combination with the structural stiffness of the entire platform and the pinion truck assembly, helps maintain pinion alignment with the rack. That is, a rack is sandwiched between the idler wheels 133 of each pinion assembly (131, 135, 140) during travel of the drive pinion truck 130.

The arrangement allows the drive and idler pinion assemblies to go around corners and maintain a constant clearance/backlash. Side loads exerted on pinion shafts in one direction are reacted by the idler wheels against the guide rails. Side loads in the opposite direction are reacted by the pinion gears against the racks. These side loads are the result of tipping moments caused by off-center loads on the platform or the reaction to leveling forces from the platform leveling system. They can also be the reaction of forces/torque exerted by the drive pinions on the gear racks or simple guiding forces as the drive pinion truck 130 transitions through a change in direction.

As described above, the transport system 10, including the platform assembly 100 and the transport track 200 utilize a rack and pinion interface. As should be appreciated, drive pinion and gear rack tooth forms pose one of the more significant challenges to allowing a rack and pinion drive system to negotiate corners. Accordingly, various structure, as discussed below, may be used in the transport system 10.

For example, inside corners or corners where the rack's teeth face inward are the same as ring gears and may be provided with pinion tooth forms to match. Outside corners or corners where the rack's teeth face outward are the same as spur gears and may be provided with pinion tooth forms to match. Straight sections of rack have pinion tooth forms to match and gentle changes in direction can be absorbed by normal operation clearances and/or backlash. The challenge is to allow a drive pinion with a single tooth form to negotiate all three rack tooth forms without binding or excessive backlash.

Figure 8:
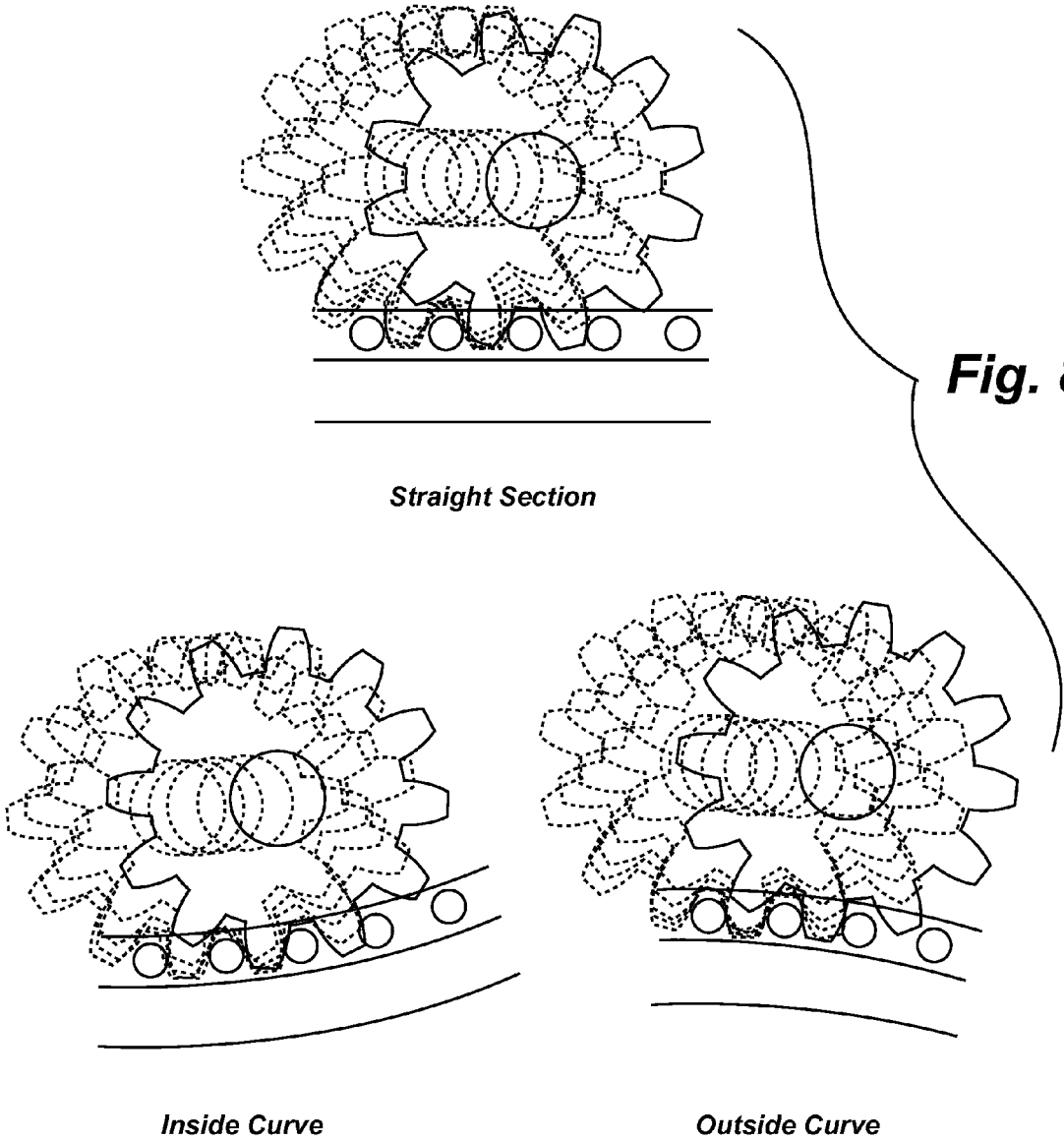
FIG. 8 is a schematic diagram showing aspects of meshing studies in accordance with one embodiment of the invention.

One solution, which may be utilized in the transport system 10, is the use of crossbars in place of gear rack teeth. Circular cross-section bars placed on a constant pitch allow a drive pinion with conventional involute teeth to successfully transit straight sections and both inside and outside corners. A second option is the use of a more sprocket like drive pinion tooth form much like any roller chain sprocket. Meshing studies have demonstrated the effectiveness of both solutions down to a corner radius of 36 inches, which is currently the design corner radius for the transport system 10. FIG. 8 illustrates the three pinion/rack transitions.

The transport system 10 primary drives, i.e., the primary drive motor 152 illustrated in FIG. 9, propel the platform assembly 100 along its guide rails/racks. The system can move vertically, horizontally or any angle in between within a vertical plane. Drive forces are transferred to the ship's structure through the gear racks (222, 224). The drive pinions (132, 137), which travel along the gear racks, are rotated by the primary drives 150. Primary drives 150 are located at both longitudinal ends of the cargo platform, shown in FIG. 3, and are almost identical. They differ from each other only in the rotation direction of each primary drive motor 152 and which side of the truck housing/gearbox 139 the drive pinions extend from. Each drive includes a pinion truck 130, a gear reducer 154, a motor adaptor 153, a motor 152 and a motor brake, i.e., a service brake 176, as shown in FIG. 9. The two primary drives 150 are mechanically linked together by a jackshaft 172, which runs across the cargo platform 110 inside its structural spine as depicted in FIG. 3. The jackshafts 172 keep the two primary drives 150 running together and allows for the sharing of torque as the center of gravity (CG) of different loads shift back and forth on the cargo platform. Each drive generates approximately half the torque/horse power (plus margin) required to lift the drive pinion truck 130 at rated gross weight and at rated velocity. Thus, torque sharing is required as the load on one drive increases and decreases on the other.

Each drive pinion truck might be characterized as a large gearbox as shown in FIG. 9 and FIG. 10. The drive pinion truck 130 includes a truck housing 139, as shown in FIG. 9. A truck 130 further includes a primary drive pinion assembly 131 (primary drive pinion 132, pinion shaft 134 and two idler wheels 133), a secondary drive pinion assembly 135, and an idler pinion assembly 140. The drive pinion truck 130 also includes a side idler 144, and a parking brake assembly 182.

An upper lobe of the truck housing 139 houses the motor 160, reduction drive 161 and pinion shaft for the platform leveling system. When the drive pinion truck 130 is traveling upward, the primary drive pinion assembly 131 is located at the bottom of the truck 130 on the cargo platform pivot centerline. The idler pinion assembly 140 is near the upper end of the truck and directly above the primary drive pinion 131. The secondary drive pinion assembly 135 is offset in a side lobe of the truck housing (gearbox) 139 and between the primary and idler pinions in height. A side idler 144 is attached to the outside of the truck gearbox 139 on the side opposite the secondary drive pinion side lobe. As shown in FIG. 10, the parking brake 182 is housed within the truck gearbox 139 and is located on the pinion shaft 134 of the idler pinion assembly 140. The leveling drive equipment (160, 161, 169) is located above the idler pinion assembly 140 in an upper lobe of the truck 130.

Each pinion/idler wheel assembly (131, 135, 142) is located on the outside of the truck 139 i.e., so as to engage with the transport track 200, and the two truck assemblies 130 are mirror images of each other. In accordance with one embodiment of the invention, all pinion assemblies are of similar structure regardless of function, i.e., in terms of the pinion, idler wheels, and shaft, for example. The pinion shafts 134 may be provided to rotate in tapered roller bearing sets, which are, in turn, housed in the two side plates of the truck gearbox. The primary drive pinion assembly 131 is directly driven by the primary drive motor and reduction gearbox. The primary and secondary pinion assemblies (131, 135) may be mechanically linked together by a three-strand HY-VO chain assembly. The chain, sprockets and a suitable tensioner operate inside the truck gearbox 139 in an oil bath.

As noted above, the drive pinion truck 130 may be provided with a parking brake 182. The parking brake includes an external tooth drum 184 and sliding toothed jaw 186, which engages the external tooth drum 184. The drum part of the brake is attached to the idler pinion shaft and rotates with it. The jaw part of the brake slides into and out of engagement with the teeth on the outside diameter of the drum in guides, which are parts of the side plates of the truck housing/gearbox 139. When the transport system 10 has come to a complete stop, the brake jaw is engaged so as to retain the drive pinion truck 130 in a particular position vis-à-vis the guide rail-guide rack assembly 220. The brake jaw may be engaged and controlled using any suitable mechanical or electromechanical arrangement.

As described above, the primary drive system 150 includes a primary drive reduction gearbox 154, i.e., a primary drive gear reducer, as shown in FIG. 9. The primary drive reduction gearbox 154 is attached directly to the lower end of each drive truck gearbox 139. The primary drive reduction gearbox 154 is positioned in line with the primary drive (131) pinion centerline and drives the pinion shaft (of the primary drive 131) through a coupler. Each reducer 154 may be in the form of a three-stage planetary gearbox designed to deliver the 14,000 ft-lb of torque at 38.2 rpm required to drive the drive pinion truck 130 vertically, at full rated gross weight and at normal operating speed, in accordance with one embodiment of the invention. The overall reduction ratio of the gear reducer may be 45:1.

As shown in FIG. 11, the primary drive reduction gearbox 154, and specifically the housing thereof, is the structural element on which the cargo platform 110 rotates relative to the pinion truck/primary drive. Cargo platform pivot bearings 122 (shown in FIG. 4 and FIG. 5) attach directly to the reducer housing outer diameter. For example, the reducer housing outer diameter might be on the order of 20 inches. All cargo platform loads are transferred through the pivot bearings 122 directly onto the housing of the primary drive reduction gearbox 154 and then transferred on to the pinion truck.

The primary drive motor 152, as shown in FIG. 10, may be of any suitable construct so as to provide the power needed to effect operation of the transport system 10. For example, the primary drive motor 152 may be a 460 Vac, 3 phase, 60 Hz unit, rated at 75 hp at 1750 rpm. As shown in FIG. 9, each electric motor 152 attaches to its respective reducer 154 through a NEMA C-Face adaptor/spacer 153, which structurally joins the two units (152, 154) together and provides room for the motor shaft to reducer input shaft coupler. Each primary drive motor is equipped with a motor brake, as shown in FIG. 9, which serves as a service brake for the transport system 10.

Various brakes may be used in the transport system 10. The transport system 10 brakes can be divided into three separate categories: service, emergency and parking. System service brakes 176 are located directly on the primary drive motor 152, as shown in FIG. 9 and FIG. 11. The brake 176 is electrically activated and designed to augment a soft start/stop motor control system. For example, the service brakes 176 may use a brake rated to deliver up to 300 foot-pounds of dynamic torque to the motor shafts on command from a suitable control system. This is amplified by the 45:1 driveline reduction ratio to the nearly 14,000 ft-lb per side required to stop the transport system platform assembly 100 when operating vertically at full capacity. The service brakes 176 (like drive motors 152) can share torque from one side of the system to the other as required. This torque sharing is accomplished through the jackshaft 172 that links the two primary drives 150 together.

The second brake category is emergency brakes 175, shown in FIG. 11. In accordance with one embodiment of the invention, these brakes 175 are spring activated and electrically released. They are designed to stop the system in the event of a power failure, over-speed condition or any other type of emergency situation. An illuminated Emergency Stop (E-Stop) may be provided to be accessible from the platform as an added safety measure, i.e., which an operator might depress upon an emergency situation developing. The emergency brake 175 is located on an emergency drive gearbox 174, which is positioned at the center of the primary drive, i.e., between the jack shifts 172 (in the cargo platform structural spine 112).

Further, the emergency gearbox 174 provides access to the transport system 10 driveline for manual operation in the event of an emergency. For example, access to the transport system 10 driveline may be provided via a manual crankshaft (or some other mechanical arrangement) that gives an operator the capability to manually drive the driveline, i.e., in a no power situation. The gearbox 174 also acts as a center bearing, i.e., a support, for the jackshaft 172. The emergency brakes 175 can be manually released and activated through a suitable emergency gearbox access panel when manual operation is required. Under normal operating conditions, the emergency brakes 175 are set (i.e., engaged so as to prevent motion of the cargo platform 110) any time power is not being supplied to the primary drive motors. The brakes are released upon motor activation.

A third brake system is the parking brake system, which is visible in FIG. 10. These brakes 182 are located inside the two pinion truck gearboxes 139 at the ends of the cargo platform 110 and are "dog" type brakes. These brakes are normally applied only after the transport system 10 has come to a complete stop and are released as the system starts moving. These brakes are designed to provide overload protection during load/off-load operations and to eliminate platform motion caused by the torsional wrap-up of the primary drive system. Significant fluctuations in platform loading are inevitable during load/off-load operations especially when a forklift is used. Because the service and emergency brake systems are both located at the low torque ends of the primary drive systems, the cargo platform may move up and down slightly as the load increases and as the forklift (if used) moves on and off the deck. This effect would probably be most noticeable as the transport system 10 approaches maximum capacity and the forklift moves onto the cargo platform carrying the last load. This scenario is also when the system could become temporarily overloaded. Because the parking brakes 182 act on the idler pinions 142 (in the idler pinion assembly 140) rather than through the primary drive line to the primary drive pinion 132 (in the primary drive pinion assembly 131), the parking brakes 182 also help spread the load fluctuations and any over loading across two pinions per side (four pinions in total).

Figure 12:
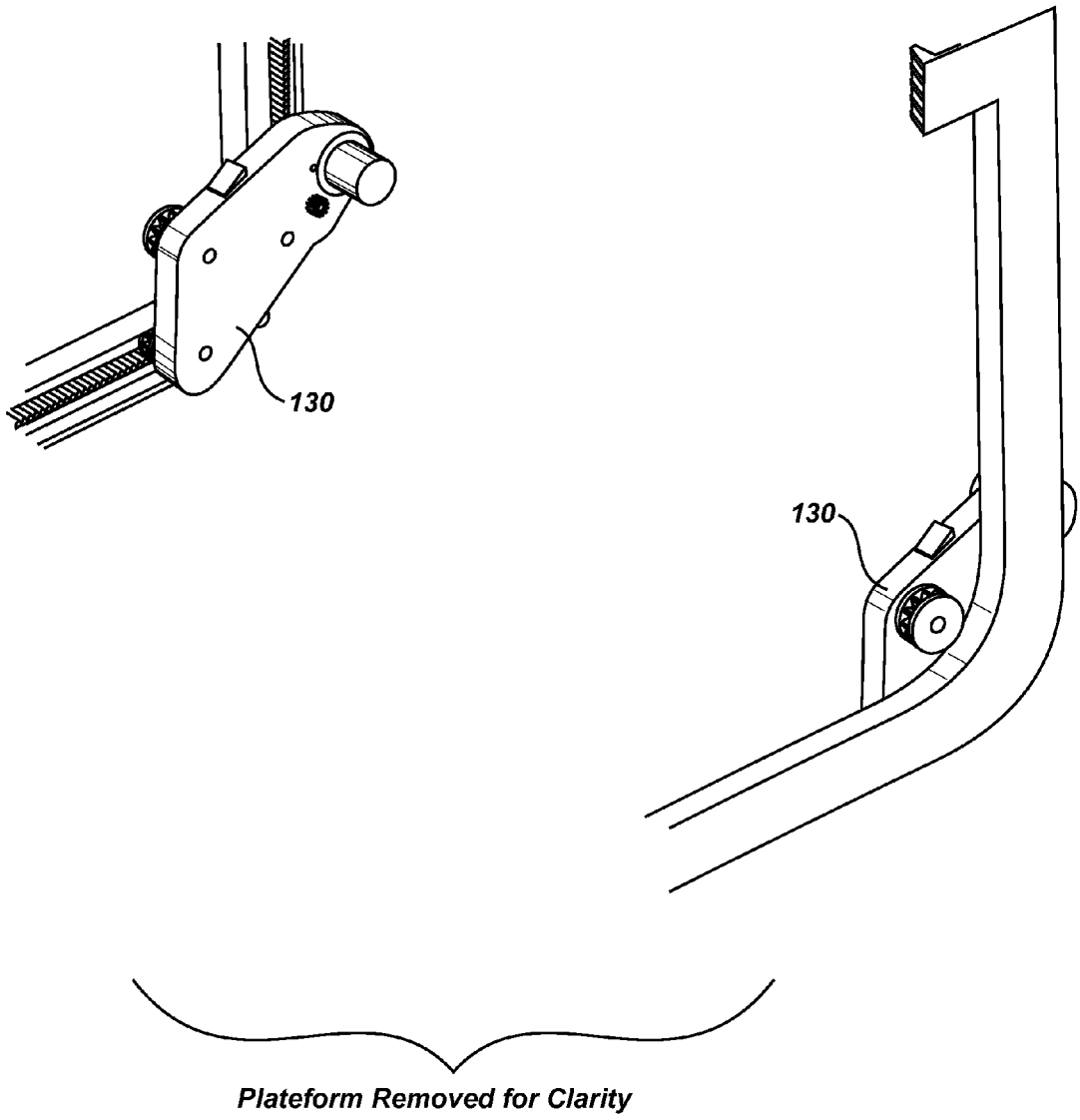
FIG. 12 is a perspective view of a drive pinion truck turning a corner in accordance with one embodiment of the invention.

The primary drive systems 150 and the drive pinion trucks 130 are designed to allow the transport system 10 to negotiate corners and pass across gaps in the guide rails/gear racks 220. The negotiation of corners, illustrated in FIG. 12, requires that only one drive pinion be driving per pinion truck. As discussed above, the differences between gear racks and drive systems from one end of the system to the other are absorbed as small changes in end to end platform level and therefore do not present a problem. Drive train wrap-up between two pinions coupled together in the same gearbox and operating on the same rack, however, can be significant. The problem is intensified if this arrangement is required to transit a corner. As the leading pinion enters a corner (or enters into any change in direction) its motion becomes a resultant vector while the motion of the trailing pinion continues to be in one direction only. This error intensifies until the trailing pinion enters the corner. This phenomenon is of interest relative to the design of the transport system 10, due to the requirement that the system be able to cross gaps in the guide rails/gear racks.

Relatedly, the system could be propelled by two pinions, one in each pinion truck, and use idler wheels at a reasonable wheelbase to provide for torque reaction, deck stability and truck direction control. Gap crossing, however, requires two driving pinions per truck, which would be in direct conflict with the negotiation of corners. To accommodate the two requirements while avoiding damaging torsional stresses in the drive system (wrap-up), the transport system 10 does employ two driving pinions (132, 137) on each pinion truck, but they do not both drive the system all the time.

Two design solutions have been considered. In both solutions, the pinion that drives the system most of the time is designated "Primary" and the second drive pinion is designated "Secondary". One option is to simply clutch the secondary drive pinion into the drive system when a gap is crossed and declutch it out of the drive system the rest of the time. The disadvantage to this solution is that while clutching the secondary pinion in, is relatively easy and straight forward, declutching the fully loaded secondary pinion after a vertical gap crossing is likely to be a problem. A second disadvantage to the clutching solution is the relative complexity of a clutching system that can handle the high torques required (14,000 ft-lb) in a reasonable volume. Some kind of "dog" type clutch would be required and engagement timing is a potential issue. Designing the clutch to take full load when required and doing so every time without a jolt resulting from taking up slack, might not be practical.

Figure 13:
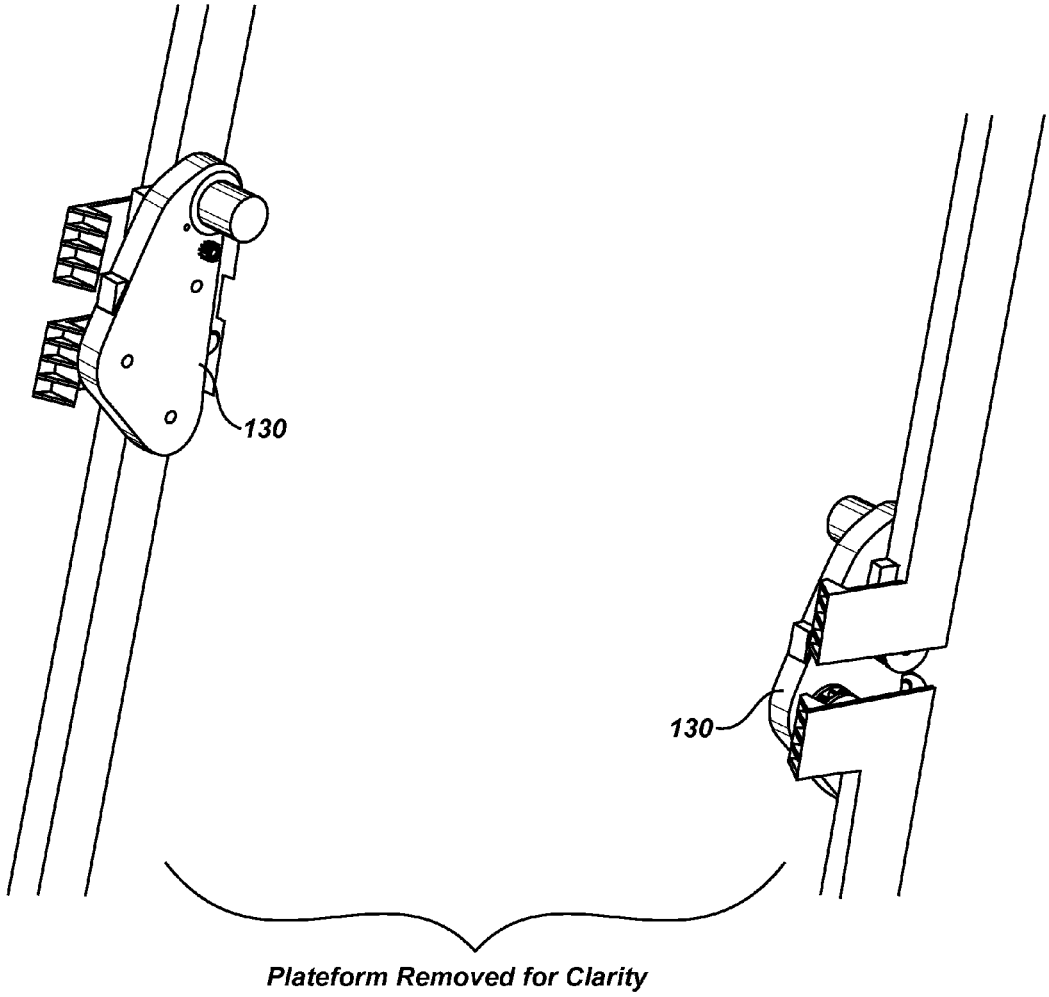
FIG. 13 is a perspective view of a drive pinion truck crossing a guide rail/gear rack gap in accordance with one embodiment of the invention.
Figure 14:
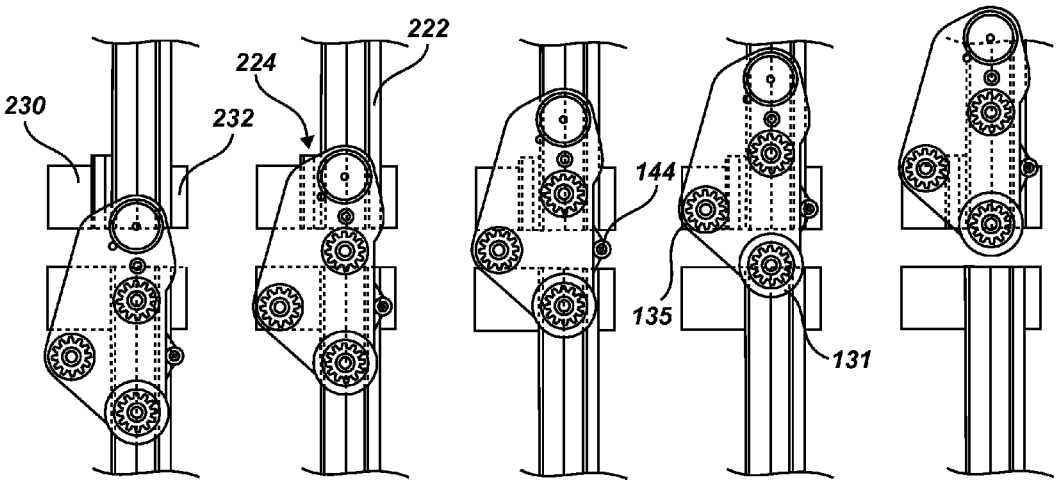
FIG. 14 is a schematic diagram showing a drive pinion truck gap crossing sequence in accordance with one embodiment of the invention.

The second solution considered and the one likely preferred for use on the transport system 10 is to offset the secondary drive pinion to one side of the guide track and drive it at all times as illustrated in FIG. 10 and FIG. 13. In this solution the secondary pinion is located half way between the idler pinion and the primary drive pinion and offset to one side. A short, offset, secondary gear rack 224 is provided at gaps but is absent elsewhere as shown in FIG. 6 and FIG. 14. This secondary rack 224 is positioned so that the secondary drive pinion propels the system only when the primary drive pinion is crossing the gap. When the secondary gear rack ends, the secondary drive pinion is automatically disengaged. The secondary drive pinion continues to rotate but because it no longer engages a gear rack, torque buildup between the two drive pinions is then impossible.

Maintaining pinion truck directional control is also an issue when crossing gaps in the guide rail/gear rack. This sequence is illustrated in FIG. 14. Directional control of the pinion truck is normally maintained between the upper idler pinion 142 (see FIGS. 10 and 14) and the primary drive pinion 132 at the bottom of the pinion truck 130. When the upper idler pinion 142 enters the gap, however, directional control is lost unless intermediate devices guide the pinion truck. The same unstable condition is repeated when the primary drive pinion crosses the gap. Accordingly, directional stability is maintained in the transport system 10 by a side idler 144 located on the exterior of the pinion truck gearbox 139 and the idler wheels 133 on the secondary drive pinion 137. The side idler 144 is located on the side of the pinion truck 130 opposite from the secondary drive pinion lobe. These intermediate guide devices 144 roll against special track wing guides 230 (as shown in FIG. 6) that, like the secondary gear rack sections 224, are installed only at gaps in the guide rail/gear rack 220. These special guides 230 are positioned on both sides of a gap, but are only long enough to perform their function.

When the upper idler pinion 142 enters a gap 202, directional control of the truck is temporarily passed to the intermediate devices (135, 144) and the pinion truck is guided between the primary drive pinion and these intermediate rollers 144. Directional control is then passed back to the upper idler 142 (in the idler pinion assembly 140) and the primary drive pinion 132 as the intermediate devices enter the gap. When the primary drive pinion 132 enters the gap, directional control of the truck is again passed to the intermediate devices (135, 144) and the pinion truck is guided between the upper idler pinion 142 and these intermediate rollers 144. Once the primary drive pinion 132 has crossed the gap and pinion truck directional control is again reestablished between the upper idler pinion 142 and the primary drive pinion 132, the wing guides 230 end. With the wing guides no longer present on the guide rail assembly, the pinion truck is again free to negotiate a corner.

In accordance with one embodiment of the invention, as discussed above, the two-track system cannot operate effectively without the cargo platform 110 being free to rotate independent of the pinion trucks. This basic design requirement, in one embodiment, dictates that either an active or passive leveling system be employed to maintain the cargo platform in a level state relative to the ship. In an embodiment, space constraints coupled with the need to control the forces and displacements caused by off-center loads decrease the effectiveness of using a passive platform leveling system. Accordingly, the transport system 10 is equipped with an active leveling system.

Figure 15:
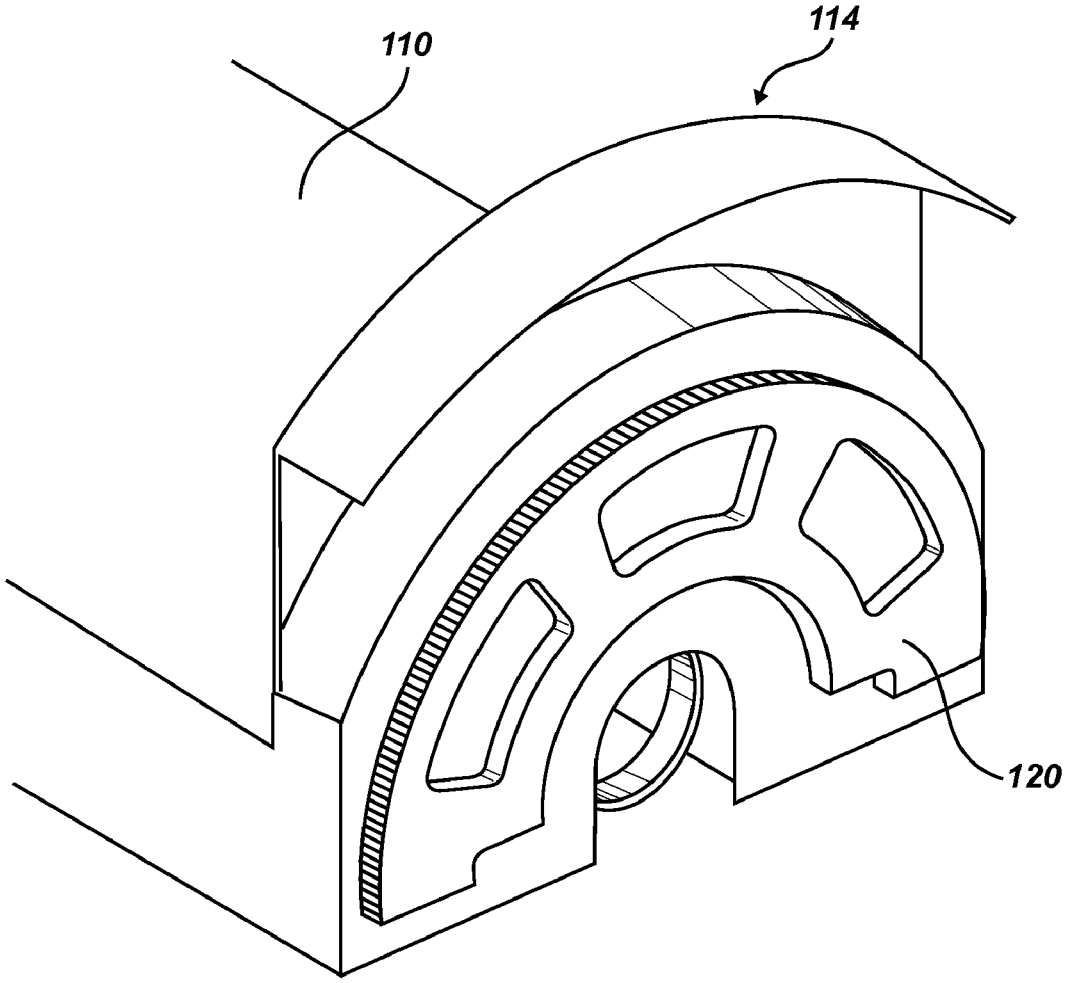
FIG. 15 is a perspective view of a leveling system bull gear in accordance with one embodiment of the invention.
Figure 16:
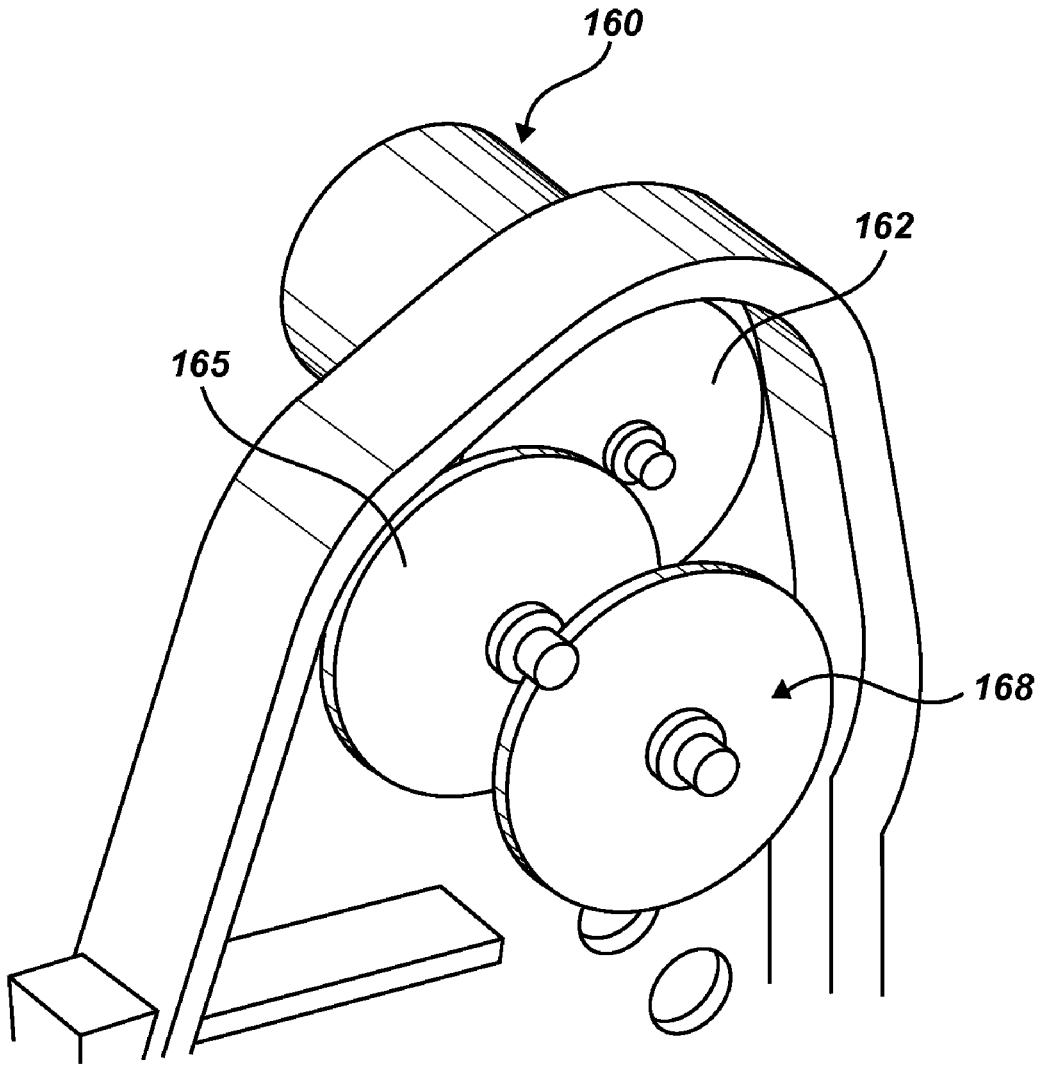
FIG. 16 is a perspective view of a leveling system drive train in accordance with one embodiment of the invention.

Hereinafter, aspects of the leveling system will be further described. Platform leveling moments, resulting from active control system inputs during a system transition in direction or the result of off-center loading, are transferred from the platform to the pinion trucks through two large diameter bull gears, one of which is shown in FIG. 15. These bull gears 120 have a pitch diameter of 90 inches, for example, and are attached to the cargo platform 110, one at each end. Only the upper 180 degrees of each gear 120 is used. Leveling moments are transferred from the bull gears 120 into the two pinion trucks through leveling drive pinions 169. These pinions 169 are part of the leveling drive train 161 housed in the upper lobe of each pinion truck gearbox 139 detailed in FIG. 9, FIG. 10, and FIG. 16. In accordance with one embodiment of the invention, individual leveling drives employ a motor 160 with 20 hp and integral brake. The internal (inside the pinion truck gearbox) portion of each drive includes the motor pinion 162, an intermediate shaft 165 and the pinion shaft 168. Two 4:1 reductions coupled with the 22.5:1 reduction between the drive pinion and the bull gear yields a 360:1 overall reduction ratio. With the motor running at 1800 rpm, the cargo deck rotates at 5 rpm. The cargo deck rotation will be synchronized with the pinion trucks transiting a corner by reducing the pinion truck speed in the corner from 120 ft/min to 94.25 ft/min. The leveling system provides the required torque to positively control the cargo platform with the CG of a full rated transport system 10 load (24,000 lb) shifted 24 in off the platform pivot center to either side.

As described above, various aspects of embodiments of the transport system 10 are arrangements that an operator will control and/or monitor, or alternatively (or in addition to), arrangements that are controlled and/or monitored in some automated manner. Any suitable computer or monitoring system may be used to effect such control and/or monitoring. In particular, the arrangements relating to movement of the cargo platform 110 along the transport track 200, passage of the drive pinion trucks 130 over gaps in the transport track 200 and leveling of the cargo platform 110 may well be subject of monitoring and/or control using a suitable control system and/or automated monitoring and/or automated control system.

Further, the power requirements of the various components in the transport system 10 may be provided in any suitable manner. For example, electrical power may be provided to the various components in the transport system 10 (e.g. the primary drive motor 152, the drive leveling motor 160, and brake systems) conductively or inductively using a suitable track or other arrangement.

It will be readily understood by those persons skilled in the art that the present invention is susceptible to broad utility and application. Many embodiments and adaptations of the present invention other than those herein described, as well as many variations, modifications and equivalent arrangements, will be apparent from or reasonably suggested by the present invention and foregoing description thereof, without departing from the substance or scope of the invention.

Accordingly, while the present invention has been described here in detail in relation to its exemplary embodiments, it is to be understood that this disclosure is only illustrative and exemplary of the present invention and is made to provide an enabling disclosure of the invention. Accordingly, the foregoing disclosure is not intended to be construed or to limit the present invention or otherwise to exclude any other such embodiments, adaptations, variations, modifications and equivalent arrangements.

What is claimed is:

1. A transport system comprising:

a transport track comprising:

a primary gear rack comprising multiple sections with at least one gap between one or more sections of the primary gear rack;

a secondary gear rack comprising multiple sections with at least one gap between one or more sections of the secondary gear rack, with the secondary gear rack having gaps between sections of the secondary gear rack at about locations corresponding to each gap in the primary gear rack; and a platform assembly adapted to move along the transport track, the platform assembly including:

a cargo platform; and a pair of drive pinion trucks mounted on opposing sides of the cargo platform, each drive pinion truck comprising a primary drive pinion assembly and a secondary drive pinion assembly with the primary pinion assembly adapted to engage with the primary gear rack and the secondary drive pinion adapted to engage with the secondary gear rack for movement along the transport track, wherein the primary drive pinion assembly and secondary drive pinion assembly are positioned to allow the secondary drive pinion assembly to engage the secondary gear rack at about the location where the primary drive pinion assembly is at about a gap in the primary gear rack.

2. The transport system of claim 1, wherein each drive pinion truck further includes an idler pinion assembly, the idler pinion assembly adapted to engage the primary gear rack.

3. The transport system of claim 2, wherein when the transport track is vertically aligned, the idler pinion assembly is vertically aligned with the primary drive pinion assembly.

4. The transport system of claim 3, wherein the secondary drive pinion assembly is offset from the vertical alignment from the primary drive pinion assembly and idler pinion assembly.

5. The transport system of claim 2, wherein each of the primary drive pinion assembly, the secondary drive pinion assembly, and the idler pinion assembly includes a pinion and a pair of idler wheels, the pinion disposed between the respective pair of idler wheels.

6. The transport system of claim 2, wherein the drive pinion truck further includes a leveling assembly, the leveling assembly maintaining the cargo platform level during transport of the cargo platform along the transport track.

7. The transport system of claim 6, wherein the leveling assembly includes a drive leveling motor operatively connected to a leveling drive pinion, the leveling drive pinion engages with a leveling system bull gear.

8. The transport system of claim 7, wherein the drive leveling motor is operatively connected to the leveling drive pinion through a leveling drive gear reduction train.

9. The transport system of claim 2, wherein the primary drive pinion assembly is operatively connected to the secondary drive pinion assembly through a chain.

10. The transport system of claim 2, wherein the primary drive pinion assembly is driven by a primary drive system, the primary drive system including a primary drive motor.

11. The transport system of claim 10, wherein the primary drive system further includes a primary drive reduction gearbox and a primary drive reduction gearbox.

12. The transport system of claim 11, wherein the cargo platform includes a pivot bearing, the cargo platform pivotable on the pivot bearing; and wherein the drive pinion truck further includes a leveling assembly, the leveling assembly maintaining the cargo platform level during transport of the cargo platform along the transport track.

13. The transport system of claim 12, wherein the pivot bearing is mounted on the primary drive system.

14. The transport system of claim 1, wherein each of the drive pinion trucks further includes a side idler, and the secondary rack assembly includes a wing guide adjacent a gap, the side idler engageable with the wing guide.

15. The transport system of claim 1 wherein each gap between one or more sections of the primary gear rack is about twelve inches (12").

16. The transport system of claim 1 wherein each gap between one or more sections of the primary gear rack is sufficient to allow one of a bulkhead door and a ballistic hatch to close within each gap.

17. The transport system of claim 1 wherein each section of the secondary gear rack being shorter than the one or more sections of the primary gear rack between each gap in the primary gear rack with a section of the secondary gear rack positioned on each side of each gap in the primary gear rack.

18. A method of transporting a platform assembly along a transport track, the method comprising:

providing a transport track having a gap having one or more gaps in the transport track with the transport track comprising a primary gear rack and a secondary gear rack at about both sides of each gap in the transport track; and providing a platform assembly that transports along the transport track, the platform assembly including:

a cargo platform; and a pair of drive pinion trucks mounted on opposing sides of the cargo platform, each drive pinion truck engaged with the transport track for movement along the transport track; and wherein the drive pinion truck includes a primary drive pinion assembly and a secondary drive pinion assembly, each of the primary drive pinion assembly and a secondary drive pinion assembly engages with the transport track; and wherein the drive pinion truck further includes an idler pinion assembly, the idler pinion assembly engages with the transport track; and engaging the primary drive pinion assembly and the idler pinion assembly with the primary gear rack, of the transport track, while the platform assembly is not positioned adjacent the gap; and engaging the secondary drive pinion assembly with the secondary gear rack, of the transport track, while the platform assembly is positioned adjacent the gap, during a portion of which each of the primary drive pinion assembly and the idler pinion assembly are disengaged from the primary gear rack.

19. The method of claim 18, wherein the secondary gear rack is only provided at about each gap with the secondary gear rack being on both sides of each gap.

20. The method of claim 18 wherein each gap in the transport track is about twelve inches (12").

21. The method of claim 18 wherein each gap in the transport track is sufficient to allow one of a bulkhead door and a ballistic hatch to close within each gap.

* * * * *